United States Patent [19]

Iwanaga et al.

[11] Patent Number: 4,784,101

[45] Date of Patent: Nov. 15, 1988

[54] FUEL INJECTION CONTROL DEVICE

[75] Inventors: Takashi Iwanaga; Hideya Fujisawa; Masaaki Kato, all of Kariya; Masahiko Miyaki, Obu, all of Japan

[73] Assignee: Nippondenso Co., Ltd., Kariya, Japan

[21] Appl. No.: 32,569

[22] Filed: Apr. 1, 1987

[30] Foreign Application Priority Data

Apr. 4, 1986 [JP] Japan ..... 61-78848

[51] Int. Cl.[4] ..... F02M 39/00

[52] U.S. Cl. ..... 123/446; 123/467; 123/458; 123/506

[58] Field of Search ..... 123/467, 458, 500, 501, 123/446, 447, 506

[56] References Cited

U.S. PATENT DOCUMENTS

| | | | |
|---|---|---|---|
| 4,359,032 | 11/1982 | Ohie | 123/467 |
| 4;438,496 | 3/1984 | Ohie | 123/458 |
| 4,440,133 | 4/1984 | Jourde | 123/458 |
| 4,440,135 | 4/1984 | Asami | 123/467 |
| 4,471,740 | 9/1984 | Jourde | 123/446 |
| 4,475,515 | 10/1984 | Mowbray | 123/467 |
| 4,545,352 | 10/1985 | Jourde et al. . | |
| 4,669,429 | 6/1987 | Nishida | 123/458 |

FOREIGN PATENT DOCUMENTS

| | | | |
|---|---|---|---|
| 59-165858 | 2/1984 | Japan . | |
| 2009842 | 6/1979 | United Kingdom | 123/506 |

*Primary Examiner*—Carl Stuart Miller

*Attorney, Agent, or Firm*—Cushman, Darby & Cushman

[57] ABSTRACT

A fuel injection control device in which a needle valve of a fuel injector is opened and closed by two valves. The fuel injector has a pressure control chamber and a fuel chamber, and the needle valve opens a fuel injection aperture to inject the fuel in the fuel chamber to the engine when a pressure in the pressure control chamber is relatively high. One valve is provided in a passage which connects a pump, the pressure control chamber, and a reservoir, and the other valve is provided in a passage which connects the pump, the fuel chamber, and the reservoir.

21 Claims, 3 Drawing Sheets

FUEL INJECTION CONTROL DEVICE

BACKGROUND OF THE INVENTION

1. Field of the Invention

The present invention relates to a fuel injection control device which controls a fuel injection to a diesel engine.

2. Description of the Related Art

An example of a conventional fuel injection control device is shown in U.S. Pat. No. 4,545,352 (corresponding to Japanese Unexamined Patent Publication No. 59-165858). In this conventional device, a fuel injector is provided with a needle valve which is positioned at a low position or a high position according to a pressure in a pressure control chamber, to selectively prevent or allow communication between a fuel chamber and a fuel injection aperture. The fuel chamber is always supplied with a pressurized fuel, and the pressure control chamber is pressurized or depressurized by an operation of a switching valve. That is, when the pressure control chamber is pressurized, the needle valve is lowered to prevent communication between the fuel chamber and the fuel injection aperture and stop a fuel injection, and when the pressure control chamber is depressurized, the needle valve is raised to allow communication between the fuel chamber and the fuel injection aperture to carry out a fuel injection.

To supply a constant high pressure fuel to the fuel chamber and the pressure control chamber, the conventional device is provided with a pump and a pressure regulator. However, it is technically difficult to obtain a constant high pressure fuel with a pump and a pressure regulator having a simple construction. Accordingly, in place of the pump and the pressure regulator, a simply constructed plunger mechanism in which a plunger having a spill port is slidably housed in a housing having a relief port is provided. In this plunger mechanism, the plunger moves forward to pressurize the fuel until the spill port communicates with the relief port so that the fuel is pressurized to a constant pressure. However, as the stroke of the plunger is always constant, in a low load condition in which a fuel injection period is short, the fuel is still pressurized after the fuel injection is finished. Such an excessive pressurization causes a power loss at the plunger mechanism, and in addition, fuel passages should not be subjected to a high pressure for a long time.

SUMMARY OF THE INVENTION

Therefore, an object of the present invention is to provide a fuel injection control device by which fuel is not excessively pressurized and the fuel pressure is quickly lowered when the fuel injection is finished, and in which a mechanism for pressurizing a fuel to a constant value has a simple construction.

According to the present invention, there is provided a fuel injection control device comprising a fuel injector, a pump, a reserving means, a first valve, a second valve, a position sensor, and a switching means. The fuel injector has a body, a needle valve, and a pressure mechanism. The body of the fuel injector has a bore, a fuel injection aperture, and a fuel chamber formed therein. The needle valve is slidably housed in the bore of the body. The pressure mechanism has a pressure control chamber, a pressure in which causes the needle valve to prevent communication between the fuel chamber and the fuel injection aperture when a pressure in the pressure control chamber is relatively high, and causes the needle valve to allow communication between the fuel chamber and the fuel injection aperture when a pressure in the pressure control chamber is relatively low. The pump has a high pressure chamber and a pressurizing means, which pressurizes a fuel in the high pressure chamber to send the fuel to the pressure control chamber and the fuel chamber. The reserving means reserves a low pressure fuel. The first valve is provided between the high pressure chamber and the pressure control chamber, and selectively connects the pressure control chamber to the high pressure chamber or to the reserving means. The second valve selectively allows or prevents connection of the high pressure chamber and the fuel chamber to the reserving means. The position sensor senses a rotational position of the engine crankshaft, and the switching means switches the first and second valves according to the detected rotational position of the engine crankshaft.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

The present invention will now be described with reference to the attached drawings.

Figure 1:
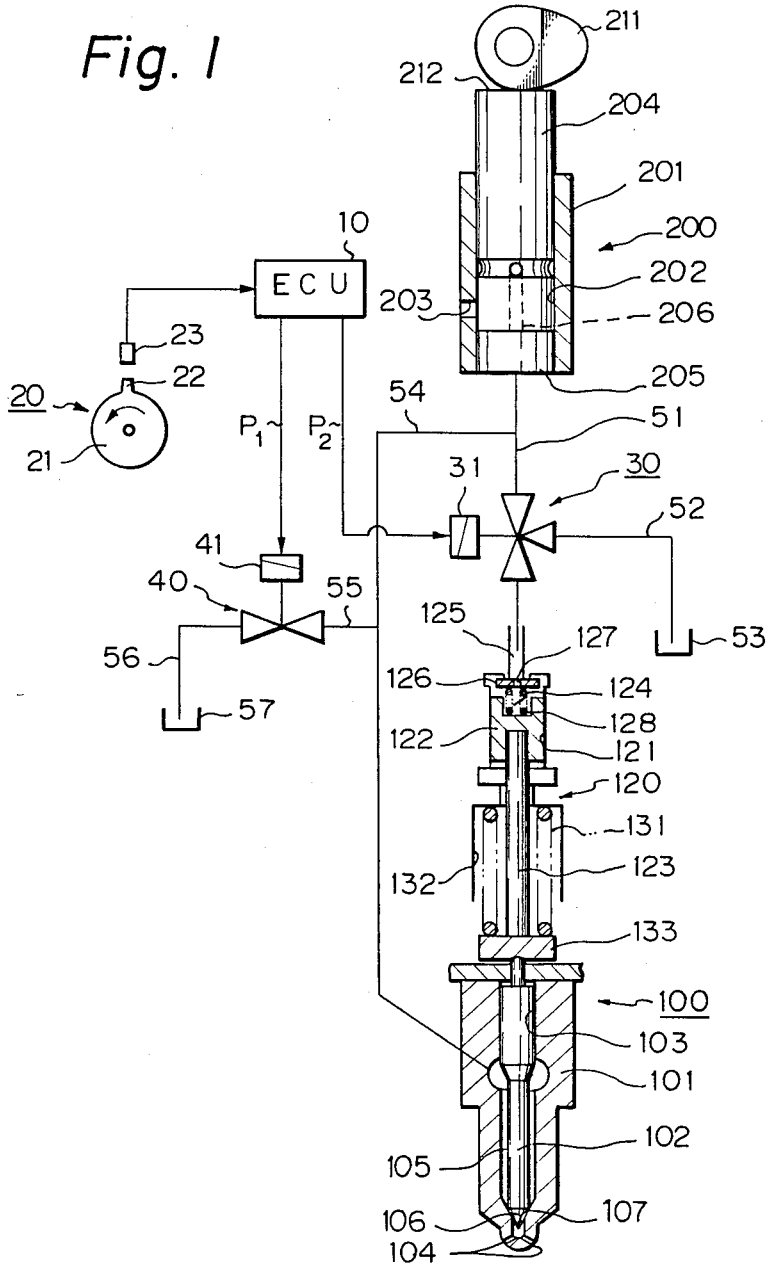
FIG. 1 is a schematic view, partly in cross section, of a first embodiment of the present invention.

Referring to FIG. 1, a fuel injector 100 mounted on a diesel engine is supplied with a highly pressurized fuel from a pump 200, and injects the pressurized fuel under the control of an Electronic Control Unit (ECU) 10 according to a signal denoting a Bottom Dead Center (BDC) position of the engine crankshaft sent from a position sensor 20. First and second electrically-controlled valves 30 and 40 are provided to control the start and stop of the fuel injection by the fuel injector 100. These first and second valves 30 and 40 are controlled by the ECU 10.

The fuel injector 100 has a body 101 housing a needle valve 102, and a pressure mechanism 120. The body 101 is formed with a bore 103, fuel injection apertures 104, and a fuel chamber 105 which is connected to the bore 103 and has a larger diameter than the bore 103. The fuel injection apertures 104 are situated at the lower end of the body 101. The needle valve 102 is slidably housed in the bore 103. The needle valve 102 has a cone-shaped portion 106 at the lower end thereof, and this cone-shaped portion 106 seats on a sealing surface 107 formed at the lower end of the fuel chamber 105 to prevent communication between the fuel chamber 105 and the fuel injection apertures 104, and separates from the sealing surface 107 to allow communication between the fuel chamber 105 and the fuel injection apertures 104.

The pressure mechanism 120 has a bore 121 and a piston 122 slidably supported in the bore 121. The piston 122 is rigidly connected to the needle valve 102 by a pin 123. A pressure control chamber 124 is defined by the bore 121 and the piston 122 at the opposite end of the pin 123 to the end connected to the needle valve 102, and is connected to a tube 125. A plate valve 126 having an orifice 127 formed therein is housed in the pressure control chamber 124 to open and close the tube 125. A small spring 128 is provided between the plate valve 126 and the piston 122 to prevent the plate valve 126 from chattering on the end of the tube 125. Note, the spring force of the spring 128 is not large enough to influence the operation of the needle valve 102.

The fuel injector 100 has a spring 131, one end of which is engaged with an upper end of a bore 132 and the other end of which is in contact with a flange 133 provided between the pin 123 and the needle valve 102, to urge the needle valve 102 in the direction by which communication between the fuel chamber 105 and the fuel injection apertures 104 is prevented.

The pump 200 has a housing 201 formed with a bore 202, and a relief port 203 which communicates with the outside atmosphere. A plunger 204 is slidably housed in the bore 202 to define a high pressure chamber 205 in the bore 202. A spill port 206 is formed in the plunger 204, one part of the spill port 206 extending along the axis of the plunger 204 and the other part of the spill port 206 extending in the diametrical direction of the plunger 204. When the plunger 204 is positioned at the lower position, the spill port 206 connects the high pressure chamber 205 to the relief port 203 so that a pressure in the high pressure chamber 205 is released.

A cam 211 is in constant engagement with the end face 212 of the plunger 204, the end face 212 being positioned at the end opposite to the high pressure chamber 205. The cam 211 is connected to a crankshaft (not shown) of the engine to rotate in synchronization with the crankshaft rotation, so that the plunger 204 is reciprocated to vary the volume of the high pressure chamber 205, and thus vary the fuel pressure in the high pressure chamber 205.

The high pressure chamber 205 and the tube 125 are connected by a first fuel passage 51, in which the first valve 30 is provided. Namely, the first valve 30 is disposed between the high pressure chamber 205 and the pressure control chamber 124. The first valve 30 is a three-way electromagnetic valve having one port connected to a leak passage 52, which is connected to a low pressure portion 53 such as a reservoir. The first valve 30 is switched by a solenoid coil 31 controlled by the ECU 10, to connect the pressure control chamber 124 to the high pressure chamber 205 when fuel injection is not carried out, and to the low pressure portion 53 upon fuel injection.

The high pressure chamber 205 and the fuel chamber 105 are connected by a second fuel passage 54 branched from the first fuel passage 51 at a point between the high pressure chamber 205 and the first valve 30. A passage 55 is branched from the second passage 54, the second valve 40 being provided of the end of the branch passage 55. An overflow passage 56 is connected to one port of the second valve 40 and extends to a low pressure portion 57 such as a reservoir. The second valve 40 is a two-way electromagnetic valve switched by a solenoid coil 41 which is controlled by the ECU 10, to allow connection of the high pressure chamber 205 and the fuel chamber 105 to the low pressure portion 57 when a fuel injection is not carried out, and prevent that connection upon fuel injection.

The ECU 10 energize or deenergizes the solenoid coil 31 and 41 in response to a signal from the position sensor 20, which senses a rotational position of the crankshaft of the engine: more precisely, senses the BDC position of the crankshaft. The position sensor 20 is provided with a rotor 21 rotating in synchronization with the rotation of the crankshaft of the engine and having a projection 22, and a pickup 23 provided near the outer periphery of the rotor 21 to sense the projection 22. The pickup 23 outputs a signal each time the projection 22 passes the pickup 23, i.e., when the rotational position of crankshaft engine is BDC, to the ECU 10.

In a non-operational state, the ECU 10 does not energize the solenoid coils 31 and 41, so that the first and second valves 30 and 40 are turned OFF. That is, the first valve 30 connects the pressure control chamber 124 to the high pressure chamber 205 of the pump 200, and the second valve 40 opens the branch passage 55 to connect the fuel chamber 105 and the high pressure chamber 205 to the low pressure portion 56. Since the fuel pressure in the fuel chamber 105 is low, the force of the spring 131 and the force pushing the piston 122 downward are larger than the pressure of the fuel urging the needle valve 102 upward. Therefore, the needle valve 102 is pressed against the seal surface 107 to prevent communication between the fuel chamber 105 and the fuel injection apertures 104, and thus a fuel injection is not carried out. Namely, a fuel injection is not carried out when a pressure in the pressure control chamber 124 is relatively high.

Figure 2:
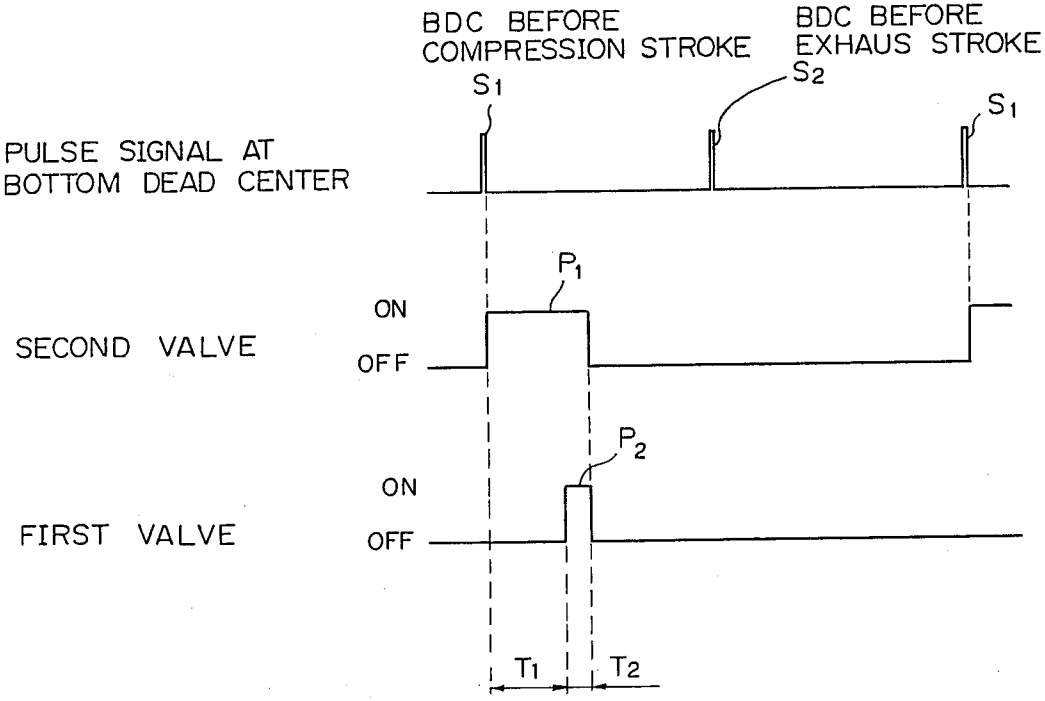
FIG. 2 is a time chart for explaining an operation of the device shown in FIG. 1; and, FIG. 3 is a schematic view, partly in cross section, of a second embodiment of the present invention.

When the crankshaft reaches BDC before the compression stroke of the piston in the engine cylinder, as shown in FIG. 2, a pulse signal $S_1$ is output from the position sensor 20 and sent to the ECU 10. The ECU 10 energizes the solenoid coil 41, as shown by $P_1$ in FIG. 2, to switch the second valve 40 and prevent connection of the high pressure chamber 205 and the fuel chamber 105 to the low pressure portion 57. At the same time, the plunger 204 is caused to descend by rotation of the cam 211, so that the fuel in the high pressure chamber 205 is pressurized, and accordingly, the pressure in the fuel chamber 105 is raised. At the end of the period $T_1$, the fuel has been fully pressurized, and thus the ECU 10 energizes the solenoid coil 31, as shown by $P_2$ in FIG. 2, to switch the first valve 30 and connect the pressure control chamber 124 to the low pressure portion 53 through the orifice 127, the tube 125 and the leak passage 52, and thus release the pressure in the pressure control chamber 124. Note, since the fuel in the pressure control chamber 124 is released to the low pressure portion 53 through the orifice 127, the pressure in the pressure control chamber 124 is reduced slowly. The pressure in the fuel chamber 105 then immediately overcomes the force of the spring 131 and the pressure in the pressure control chamber 124, and thus the needle valve 102 is moved upward and separated from the sealing surface 107. When the needle valve 102 has moved slightly upward, the area of the needle valve 102 which is subjected to a pressure pressing the needle valve 102 upward becomes large, so that the needle valve 102 moves rapidly upward. Thus, the needle valve 102 allows communication between the fuel chamber 105 and the fuel injection apertures 104 and a fuel injection is carried out. Namely a fuel injection is carried out when a pressure in the pressure control chamber 124 is relatively low.

At the end of the predetermined fuel injection period $T_2$, the ECU 10 deenergizes the solenoid coil 31 so that the first valve 30 is switched to connect the pressure control chamber 124 to the high pressure chamber 205 of the pump 200. As a result, a pressurized fuel in the high pressure chamber 205 is supplied to the pressure control chamber 124 through the first fuel passage 51. That is, the pressure of this pressurized fuel pushes the plate valve 126 downward, and thus the plate valve 126 is opened and the pressurized fuel flows into and abruptly increases the pressure in the pressure control chamber 124. At the same time, the ECU 10 deenergizes the solenoid coil 41 so that the second valve 40 is switched to connect the high pressure chamber 205 and the fuel chamber 105 to the low pressure portion 57. As a result, the fuel in the fuel chamber 105 is released to the low pressure portion 57 through the second fuel passage 54, the branch passage 55, the second valve 40, and the overflow passage 56, and accordingly, the pressure in the fuel chamber 105 is decreased, and the needle valve 102 is moved downward and seated on the seal surface 107, to shut off the fuel injection apertures 104 from the fuel chamber 105 and sop the fuel injection. Then, at the end of the compression stroke of the plunger 204, the spill port 206 is communicated with the relief port 203 to release the fuel in the high pressure chamber 205 to the outside.

As described above, according to this embodiment, the fuel pressurized by the plunger 204 is prevented from overpressurization after the fuel injection is carried out. Further, since the fuel pressure in the fuel chamber 105 is reduced during the downward movement of the needle valve 102, the needle valve 102 can move smoothly and rapidly downward to quickly stop the fuel injection.

Note, the switching operations of the first and second valves 30 and 40 that are carried out when the position sensor 20 outputs a signal $S_1$ denoting BDC before the compression stroke of the piston in the cylinder, are not carried out when the position sensor 20 outputs a signal $S_2$ denoting BDC before the exhaust stroke of the piston in the cylinder. Also, the spill port 206 and the relief port 203 need not be provided for the pump 200. Further, to prevent overpressurization of the fuel, a pressure regulator may be provided at an outlet port of the pump 200.

Figure 3:
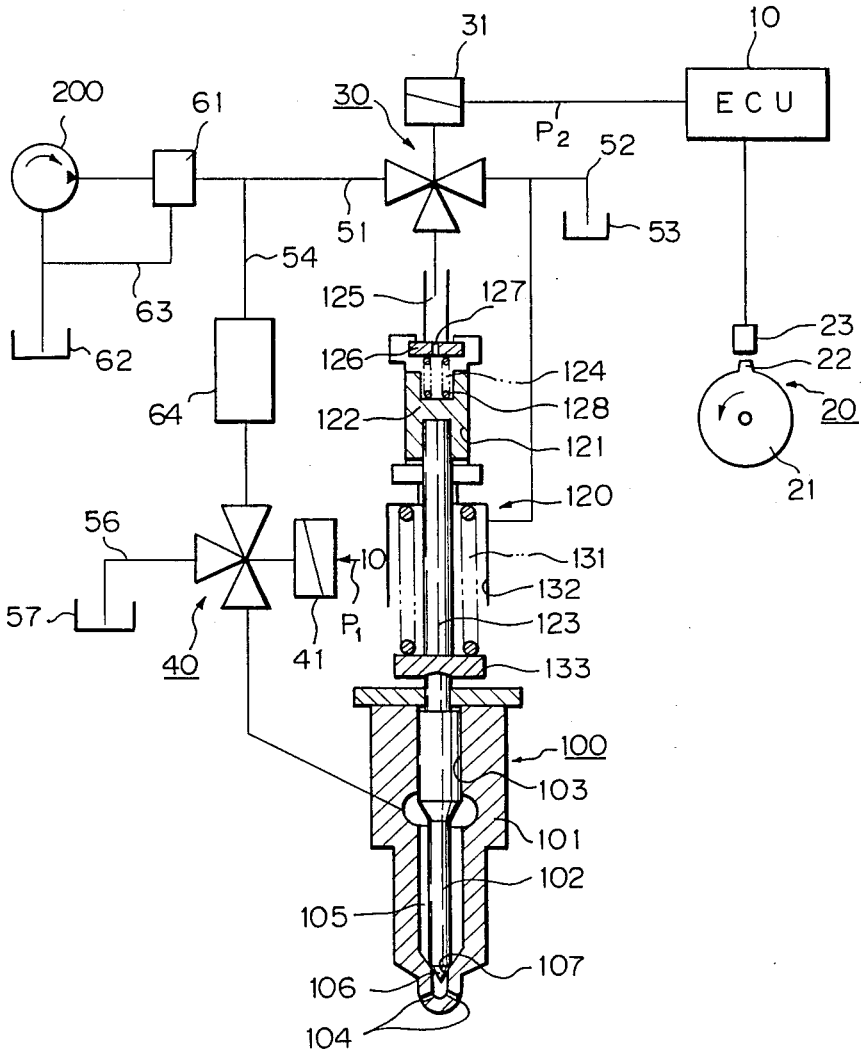

FIG. 3 shows a second embodiment of the present invention. In this second embodiment, the pump 200 supplies a pressurized fuel to the pressure control chamber 124 and the fuel chamber 105 in synchronization with the rotation of the crankshaft of the engine. A pressure regulator 61 is provided in the first fuel passage 51 to return excess fuel to a reservoir 62 through a return passage 63, and to maintain the pressure of the fuel at a constant value. The pressure regulator 61 and the pressure control chamber 124 are connected through the first fuel passage 51 and the first valve 30. One port of the first valve 30 is connected to a leak passage 52 leading to the low pressure portion 53. A second fuel passage 54 connects the fuel chamber 105 to the first fuel passage 51 at a point between the pressure regulator 61 and the first valve 30. An accumulator 64 and the second valve 40 are provided in the second fuel passage 54. The second valve 40 is a three-way electromagnetic valve, one port of which is connected to an overflow passage 56 leading to a low pressure portion 57. The remaining construction of the second embodiment is the same as that of the first embodiment.

The operation of the second embodiment is basically the same as for the first embodiment. That is, in the non-operation state, the first valve 30 connects the pressure control chamber 124 to the pump 200 and the fuel chamber 105 to the low pressure portion 57, so that the needle valve 102 shut off the fuel injection apertures 104 from the fuel chamber 105 and a fuel injection is not carried out. When a signal denoting BDC before the compression stroke of the piston in the cylinder is input to the ECU 10, the ECU 10 switches the second valve 40 to connect the fuel chamber 105 to the pump 200 through the accumulator 64 and the pressure regulator 61, so that a pressure in the fuel chamber 105 is increased. The ECU 10 then switches the first valve 30 to connect the pressure control chamber 124 to the low pressure portion 53, so that a pressure in the pressure control chamber 124 is reduced. Accordingly, the needle valve 102 is moved upward to communicate the fuel injection apertures 104 with the fuel chamber 105 and carry out a fuel injection. Subsequently, the first and second valves 30 and 40 are switched to connect the pressure control chamber 124 to the pump 200, and connect the fuel chamber 105 to the low pressure portion 57, so that the needle valve 102 is pressed downward to shut off the fuel injection apertures 104 from the fuel chamber 105 and stop the fuel injection.

To ensure a sharp cut-off of the fuel injection, the first and second valves 30 and 40 must be turned OFF at the same time. On the other hand, the second valve 40 need not be turned ON in synchronization with a BDC before compression stroke signal, but can be switched to shut off the pump 200 and the fuel chamber 105 from the low pressure portion 57 at a predetermined time for starting compression of the fuel. The period $T_1$ indicating a fuel injection time and the period $T_2$ indicating a fuel injection amount can be arbitrarily adjusted according to an engine condition such as an engine revolution value, engine load, and cooling water temperature, etc. Further, the components other than the ECU 10, the position sensor 20, and the cam 211 may be integrated as one body to be mounted near a combustion chamber of the diesel engine. Note, the plate valve 126 having the orifice 127 can be omitted without changing the basic operation of the embodiments. Instead, a valve having an orifice may be provided in the leak passage 52.

The fuel injection control devices shown in FIGS. 1 and 3 are provided at each engine cylinder in a multicylinder engine.

Although embodiments of the present invention have been described herein with reference to the attached drawings, many modifications and changes may be made by those skilled in this art without departing from the scope of the invention.

We claim:

1. A fuel injection control device for an internal combustion engine, said device comprising:

A fuel injector having a body, said body having a bore, a fuel injection aperture and a fuel chamber formed therein, a needle valve slidably housed in said bore, and a pressure mechanism including a pressure control chamber, a pressure in said pressure control chamber causing said needle valve to prevent communication between said fuel chamber and said fuel injection aperture when a pressure in said pressure control chamber is relatively high, and causing said needle valve to allow communication between said fuel chamber and said fuel injection aperture when a pressure in said pressure control chamber is relatively low, a pump having a high pressure chamber and means for pressurizing fuel in said high pressure chamber to send the fuel to said pressure control chamber and said fuel chamber, means for reserving a low pressure fuel, a first electrically-controlled on-off valve provided between said high pressure chamber and said pressure control chamber, said first valve connecting said pressure control chamber to said high pressure chamber when said first on-off valve is in a first state thereof and to said reserving means when said first on-off valve is in a second state thereof, a second electrically-controlled on-off valve provided for allowing connection of said high pressure chamber and said fuel chamber to said reserving means when said second on-off valve is in a first state thereof and preventing the connection when said second on-off valve is in a second state thereof, a position sensor sensing a rotational position of a crankshaft of said engine, and means for switching first and second states of said first and second valves according to the sensed rotational position of said crankshaft of said engine, said switching means switching said first valve and said second valve to said respective first state upon the end of a fuel injection from said fuel injector.

2. A fuel injection control device according to claim 1, wherein said pressure mechanism has a bore and a piston slidably supported in said bore and connected to said needle valve, said pressure control chamber being defined by said bore and said piston.

3. A fuel injection control device according to claim 2, wherein said pressure mechanism further has a plate valve having an orifice formed therein, said plate valve opening said pressure control chamber when pressurized fuel is led into said pressure control chamber, and closing said pressure control chamber when pressurized fuel is discharged from said pressure control chamber through said orifice.

4. A fuel injection control device according to claim 1, wherein said fuel injector has a spring urging said needle valve downward to prevent communication between said fuel chamber and said fuel injection aperture.

5. A fuel injection control device according to claim 1, wherein said pump has a housing having a bore formed therein and a relief port communicating with an outside thereof, a plunger slidably housed in said bore and having a spill port formed therein which can communicate said high pressure chamber with said relief port, and a means for reciprocating said plunger to vary a fuel pressure in said high pressure chamber, said spill port communicating with said relief port at the end of a compression stroke of said plunger to release the fuel pressure in said high pressure chamber.

6. A fuel injection control device according to claim 5, wherein said reciprocating means pressurizes a fuel in said high pressure chamber in synchronization with the rotation of said crankshaft of said engine.

7. A fuel injection control device according to claim 6, wherein said reciprocating means is a cam connected to said crankshaft of said engine.

8. A fuel injection control device according to claim 1, further comprising a pressure regulator provided between said pump and said pressure mechanism.

9. A fuel injection control device according to claim 1, wherein said high pressure chamber and said pressure control chamber are connected by a first fuel passage, said first valve being provided in said first fuel passage and connected to a leak passage, said leak passage being connected to said reserving means.

10. A fuel injection control device according to claim 1, wherein said high pressure chamber and said fuel chamber are connected by a second fuel passage, a branch passage being connected to said second passage, said second valve being provided at an end of said branch passage and connected to an overflow passage which is connected to said reserving means.

11. A fuel injection control device according to claim 1, wherein said position sensor senses the bottom dead center position of said crankshaft of said engine.

12. A fuel injection control device according to claim 11, wherein said switching means closes said second valve to prevent connection of said high pressure chamber and fuel chamber to said reserving means, in synchronization with a signal denoting a bottom dead center before a compression stroke of said crankshaft in said engine, and opens said second valve to allow connection of said high pressure chamber and fuel chamber to said reserving means in synchronization with a switching of said first valve to connect said pressure control chamber to said reserving means.

13. A fuel injection control device for an internal combustion engine, said device comprising:

A fuel injector having a body, said body having a bore, a fuel injection aperture and a fuel chamber formed therein, a needle valve slidably housed in said bore, and a pressure mechanism including a pressure control chamber, a pressure in said pressure control chamber causing said needle valve to prevent communication between said fuel chamber and said fuel injection aperture when a pressure in said pressure control chamber is relatively high, and causing said needle valve to allow communication between said fuel chamber and said fuel injection aperture when a pressure in said pressure control chamber is relatively low, a pump sending a pressurized fuel to said pressure control chamber and said fuel chamber, means for reserving a low pressure fuel, a first electrically-controlled on-off valve provided between said pump and said pressure control chamber, said first valve connecting said pressure control chamber to said pump when said first on-off valve is in a first state thereof and to said reserving means when said first on-off valve is in a second state thereof, a second electrically-controlled on-off valve provided for connecting said fuel chamber to said reserving means when said second on-off valve is in a first state thereof and to said pump when said second on-off valve is in a second state thereof, a position sensor sensing a rotational position of said crankshaft of said engine, and means for switching first and second states of said first and second valve according to the sensed rotational position of said crankshaft of said engine, said switching means switching said first valve and said second valve to said respective first state upon the end of fuel injection from said fuel injector.

14. A fuel injection control device according to claim 13, wherein said pressure mechanism has a bore and a piston slidably supported in said bore and connected to said needle valve, said bore and said piston defining a pressure control chamber connected to said pump.

15. A fuel injection control device according to claim 14, wherein said pressure mechanism further has a plate valve having an orifice formed therein, said plate valve opening said pressure control chamber when pressurized fuel is led into said pressure control chamber, and closing said pressure control chamber when pressurized fuel is discharged from said pressure control chamber through said orifice.

16. A fuel injection control device according to claim 13, wherein said fuel injector has a spring urging said needle valve downward to prevent communication between said fuel chamber and said fuel injection hole.

17. A fuel injection control device according to claim 13, further comprising a pressure regulator provided between said pump and said pressure mechanism.

18. A fuel injection control device according to claim 13, wherein said pump and said pressure control chamber are connected by a first fuel passage, said first valve being provided in said first fuel passage and connected to a leak passage, said leak passage being connected to said reserving means.

19. A fuel injection control device according to claim 13, wherein said pump and said fuel chamber are connected by a second fuel passage, said second valve being provided in said second fuel passage and connected to an overflow passage, said overflow passage being connected to said reserving means.

20. A fuel injection control device according to claim 13, wherein said position sensor senses a bottom dead center position of said crankshaft of said engine.

21. A fuel injection control device according to claim 13, wherein said switching means switches said second valve to communicate said fuel chamber with said pump in synchronization with a signal denoting a bottom dead center before a compression stroke of said crankshaft, and switches said second valve to communicate said fuel chamber with said reserving means in synchronization with a switching of said first valve to connect said pressure mechanism to said reserving means.

* * * * *